US007387227B1

(12) United States Patent
Jiang et al.

(10) Patent No.: US 7,387,227 B1
(45) Date of Patent: Jun. 17, 2008

(54) SAFETY APPARATUS FOR SPRING POWERED STAPLERS

(76) Inventors: Peigen Jiang, 19480 SE. 28th Pl., Sammamish, WA (US) 98075; Dilin Xiong, No. 1 Yihe Street, #1-2-1, Dalian, Liaoning (CN) 116001

( * ) Notice: Subject to any disclaimer, the term of this patent is extended or adjusted under 35 U.S.C. 154(b) by 0 days.

(21) Appl. No.: 11/773,407

(22) Filed: Jul. 4, 2007

(51) Int. Cl.
*B25C 1/04* (2006.01)

(52) U.S. Cl. ..... 227/8; 227/132; 227/134

(58) Field of Classification Search ..... 227/8, 227/120, 132, 134, 156
See application file for complete search history.

(56) References Cited

U.S. PATENT DOCUMENTS 3,862,712 A * 1/1975 LaPointe et al. ..... 227/127
5,356,063 A * 10/1994 Perez ..... 227/132
5,441,191 A * 8/1995 Linden ..... 227/120
6,056,181 A * 5/2000 Chuang ..... 227/8
6,209,772 B1 * 4/2001 Wang ..... 227/134
6,913,179 B1 * 7/2005 Chen ..... 227/8
6,918,525 B2 * 7/2005 Marks ..... 227/120
6,966,477 B1 * 11/2005 Chien-Kuo et al. ..... 227/8
7,124,922 B2 * 10/2006 Marks ..... 227/8
7,290,692 B2 * 11/2007 Marks ..... 227/8
7,296,720 B2 * 11/2007 Kirby et al. ..... 227/120

* cited by examiner

*Primary Examiner*—Scott A. Smith

(57) ABSTRACT

This invention provides a safety apparatus for a stapler, the safety apparatus comprises a first plate having a hook and a first opening, wherein when the first plate is in a first position, the hook engages a driving blade for preventing the same from driving out a staple, a second plate substantially parallel to the first plate and having a second opening, a pin having a first and second end, and a first spring urging the pin downward with the first end of the pin protruding from a bottom of a housing body of the stapler and the second end of the pin below the second plate, wherein when the housing body is pressed against an object, the first end of the pin is pushed into the housing body, and the second end of the pin is inserted into both the first and second openings.

20 Claims, 4 Drawing Sheets

SAFETY APPARATUS FOR SPRING POWERED STAPLERS

CROSS REFERENCE

The present application has a co-pending application: Ser. No. 11/192,793, filed Jul. 30, 2005, which is incorporated by reference in its entirety.

BACKGROUND

The present invention relates generally to staplers, and more specifically, to safety apparatus for spring-powered staplers.

A key for a staple to have good penetration is its entry speed. A spring powered stapler uses a spring to store energy. Upon a release of the stored spring energy, a staple can be driven out at a great speed. However, a fast exit staple may shoot like a bullet when not pointing at an object intended stapled. This may pose a safety concern for the spring powered stapler. As such, what is needed is a safety apparatus for the spring powered stapler.

SUMMARY

In view of the foregoing, the present invention provides a safety apparatus for a stapler, the safety apparatus comprises a first plate having a hook and a first opening, wherein when the first plate is in a first position, the hook engages a driving blade for preventing the same from driving out a staple, a second plate substantially parallel to the first plate and having a second opening, a pin having a first and second end, and a first spring urging the pin downward with the first end of the pin protruding from a bottom of a housing body of the stapler and the second end of the pin below the second plate, wherein when the housing body is pressed against an object, the first end of the pin is pushed into the housing body, and the second end of the pin is inserted into both the first and second openings. With the linking of the first and second plate by the pin, when the second plate is pulled rearward, the first plate follows the second plate to a second position where the hook disengages the driving blade.

The construction and method of operation of the invention, however, together with additional objects and advantages thereof will be best understood from the following description of specific embodiments when read in connection with the accompanying drawings.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein. It should be noted that the features illustrated in the drawings are not necessarily drawn to scale.

DESCRIPTION

The present invention provides a safety apparatus to a spring powered stapler. When the spring powered stapler is not firmly pressed against an object, attempts to operate the spring powered stapler will not result in any expulsion of staples. In fact, a driving blade of the spring powered stapler will not be released in this case.

Figure 1:
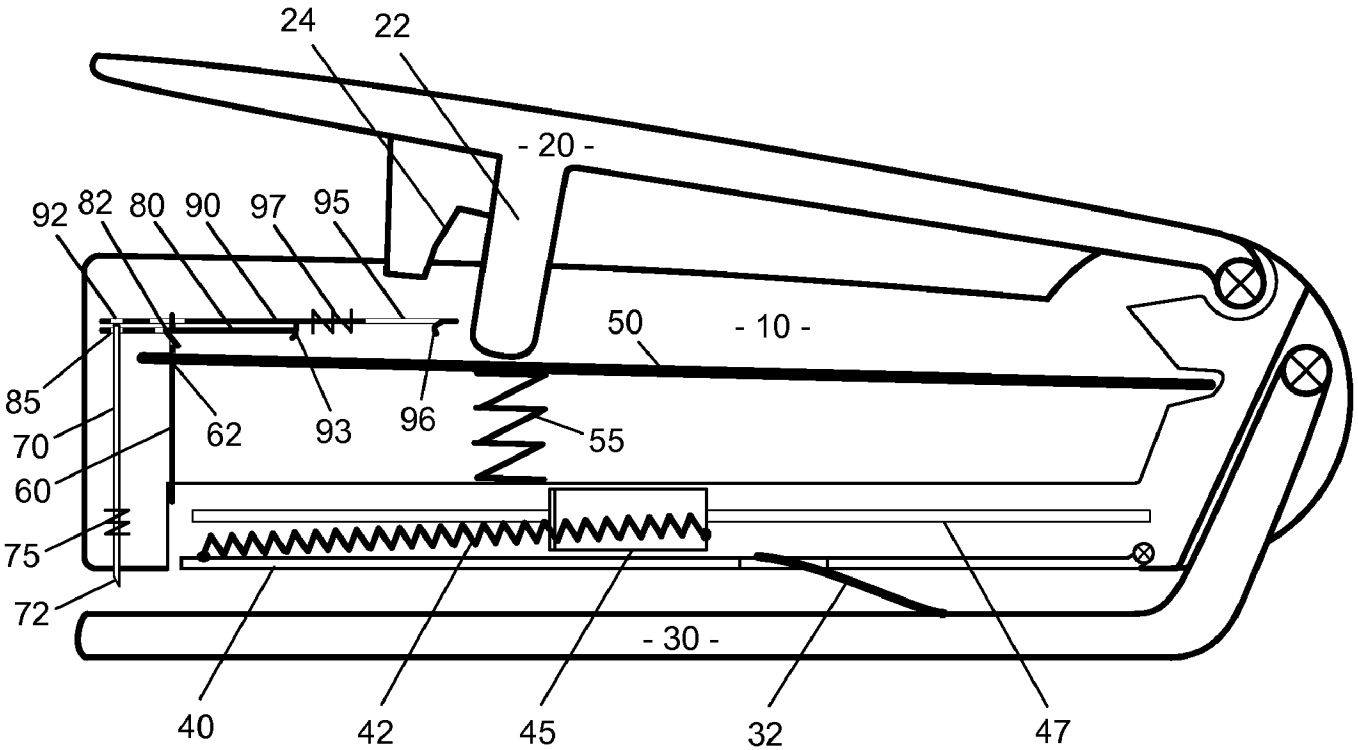
FIG. 1 is a side partial sectional view of a spring powered stapler with a safety apparatus in a resting position according to one embodiment of the present invention.

FIG. 1 is a side partial sectional view of a spring powered stapler with a safety apparatus in a resting position according to one embodiment of the present invention. The spring powered stapler comprises a housing body 10, a handle 20, a power spring 50, a return spring 55, a driving blade 60, a hook plate 80 and the safety apparatus which comprises a safety pin 70, a push-down spring 75, a link plate 90 and a push-forward spring 97. The housing body 10 also contains a staple feeding track which includes a retention panel 40, a drag spring 42, a sliding block 45 and a pair of horizontal slots 47 on opposite internal sidewalls of the housing body 10. The sliding block 45 is retained by the pair of horizontal slots 47 and capable of sliding along the slots 47. One end of the drag spring 42 is mounted on the retention panel 40, and the other end of the drag spring 42 is mounted on the sliding block 45. When the retention panel 40 is in an open position, the drag spring 42 drags the sliding block 45 to slide backward to allow more space for holding staples in the staple feeding track. When the retention panel 40 is in a closed position, the drag spring 42 drags the sliding block 45 to slide forward to push the staples a front of the staple feeding track. The foremost staple will be placed right beneath the driving blade 60. The retention panel 40 may be held in the closed position by protruding objects (not shown) at lower parts of the internal sidewalls of the housing body 10.

Referring again to FIG. 1, the handle 20 has a push-down rod 22 and a wedge-shaped surface 24 as its integral parts. A front end of the power spring 50 engages the driving blade 60 through an opening 62 thereon. A rear end of the power spring 50 is confined by a groove in the housing body 10. As a preferred embodiment of the present invention, the power spring 50 is made of a plate spring.

Referring again to FIG. 1, the hook plate 80 is slidable along a pair of horizontal slots (not shown) on the inner sidewalls of the housing body 10. When the hook plate 80 slides to a frontal position, a hook 82 on the hook plate 80 engages the driving blade 60 through an opening 67 (FIG. 3) thereon to prevent the driving blade from moving downward. When the hook plate 80 slides backward, the hook 82 is pulled out of the opening 67, then the driving blade 60 is free to be urged downward by the power spring 50.

Referring again to FIG. 1, the link plate 90 of part of the safety apparatus is also slidable along a pair of horizontal slots (not shown) on the inner sidewalls of the housing body 10. The push-forward spring 97 urges the link plate 90 to slide forward toward a front end of the housing body 10. A push piece 93 is fixed on and protrudes downward from the link plate 90. As the link plate 90 moves forward at the urge of the push-forward spring 97, the push piece 93 pushes the hook plate 80 to move forward to engage the drive blade 60. An edge 96 on a rear side of an opening 95 on the link plate 90 comes into contact with the wedge-shaped surface 24 when the handle 20 is pressed downward. Throughout the process of pressing down the handle 20, the wedge-shaped surface forces the link plate 90 to gradually slide backward due to the contact between the edge 96 and the wedge-shaped surface 24.

Figure 2A:
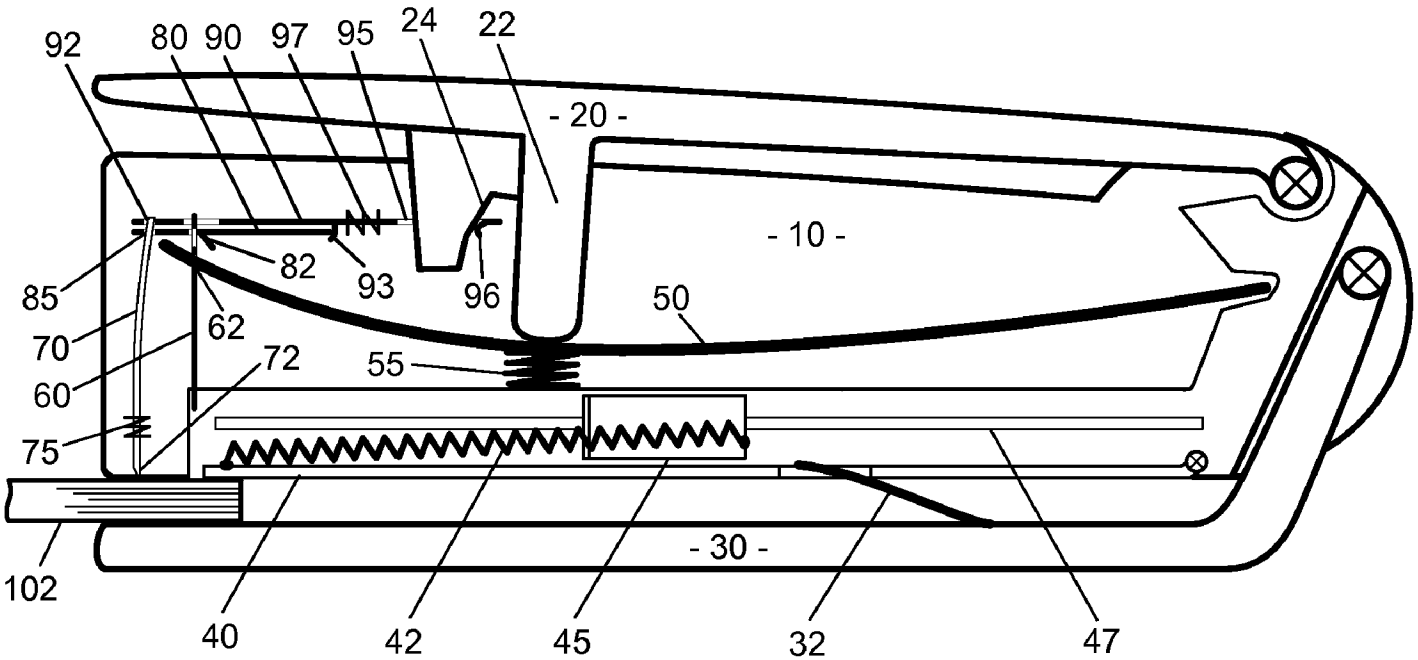
FIG. 2A is a side partial sectional view of the spring powered stapler of FIG. 1 just prior to ejecting a staple.

FIG. 2A is a side partial sectional view of the spring powered stapler of FIG. 1 just prior to ejecting a staple. There is an object 102, such as a stack of paper, being placed under the housing body 10. The object 102 pushes a tip 72 of the safety pin 70 to move upward. Then a top end of the safety pin 70 will be inserted into a second opening 92 on the link plate. As the top end of the safety pin 70 has already gone through a first opening 85 on the hook plate 80, the link plate 90 and the hook plate 80 is then locked together by the safety pin 70. When the link plate 90 moves backward at the force of the wedge-shaped-surface 24, the hook plate 80 will move backward together, and eventually release the driving blade 60. As shown in FIG. 2A, the safety pin 70 is bent, as the top end of the safety pin 70 is pulled backward, while the bottom portion of the safety pin 70 is contained in a vertical channel (not shown) formed in the housing body 10. Therefore, the safety pin is made of a flexible material, such as steel. A skilled artisan will realize that the hook plate 80 and link plate 90 may be made of a metal material, and the housing body 10 may be made of a plastic material.

Figure 2B:
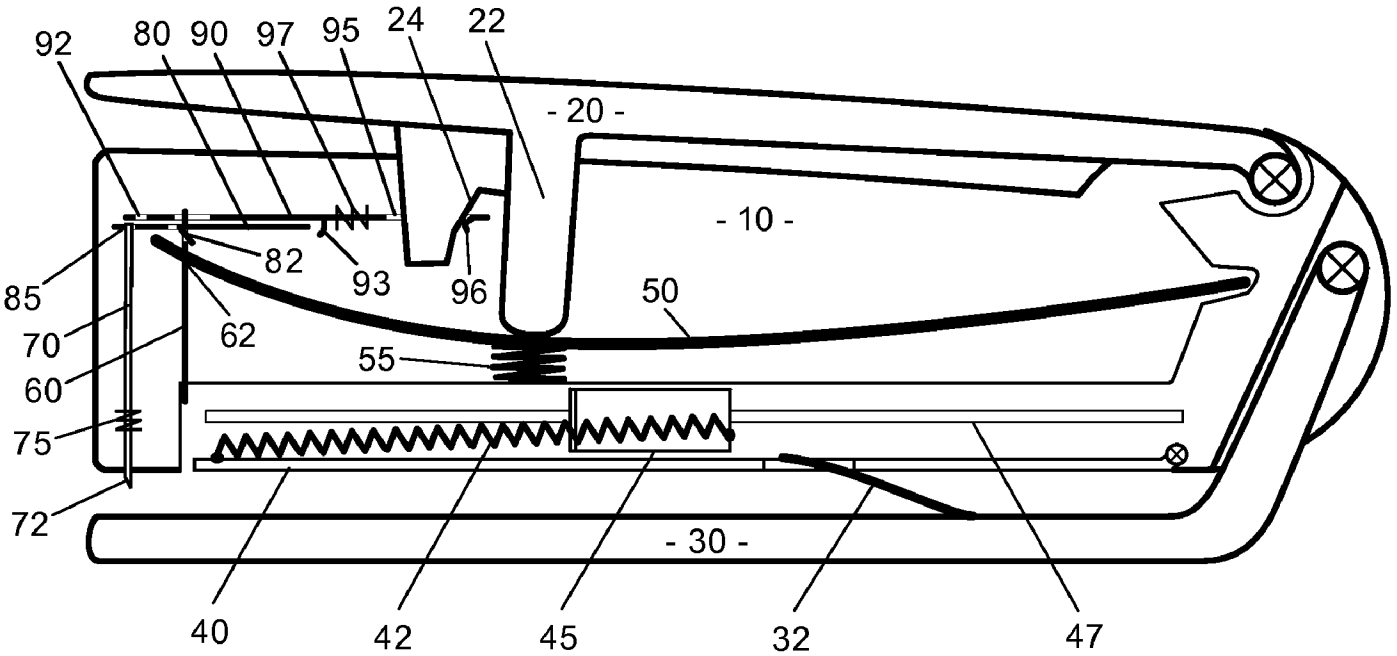
FIG. 2B is a side partial sectional view of the spring powered stapler of FIG. 1 which is prevented from ejecting a staple when there is no object for being stapled.

FIG. 2B is a side partial sectional view of the spring powered stapler of FIG. 1 which is prevented from ejecting a staple when there is no object for being stapled. In this case, there is no object underneath the housing body 10 to push up the safety pin 70. The push-down spring 75 urges the safety pin 70 to stay in a lower position so that the top end of the safety pin 70 does not reach the link plate 90. Even though the handle 20 is pressed down, and the wedge-shaped-surface 24 has pulled the link plate 90 to a rear position, without locking up the hook plate 80, the link plate 90 can not pull the hook plate 80 backward to release the driving blade 60. Therefore, in this case, there will be no staple being driven out no matter how low the handle 20 is pressed down.

Referring back to FIG. 1, in the resting position, the first opening 85 on the hook plate 80 and the second opening 92 on the link plate 90 are aligned. When not being pushed to higher position, the top end of the safety pin 70 stays in the first opening 85. How far the hook plate 80 is vertically separated from the link plate 90 depends on how far the safety pin 70 can travel upward to lock up the hook plate 80 and the link plate 90.

Figure 3:
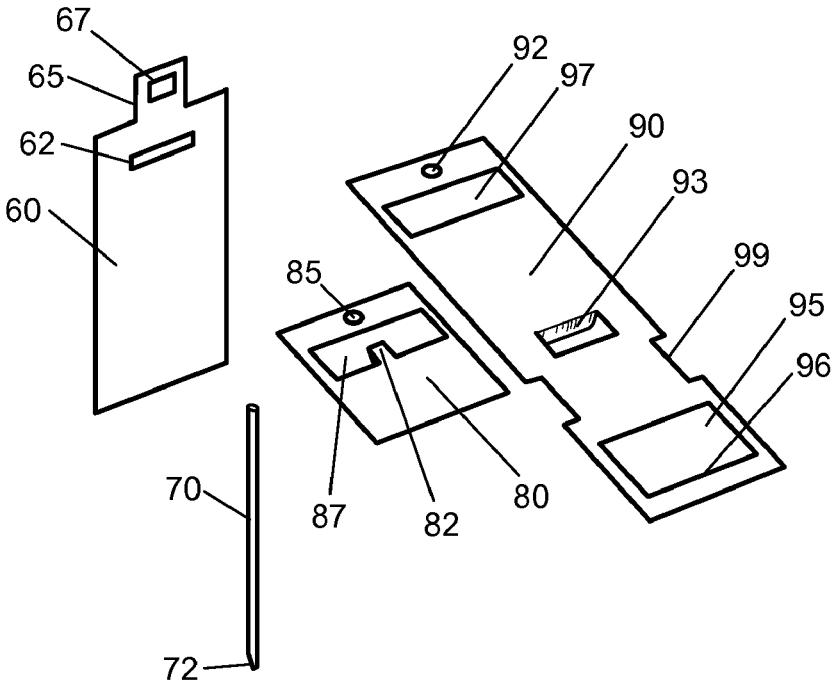
FIG. 3 is a perspective view of key elements of the safety apparatus for the spring powered stapler of FIG. 1.

FIG. 3 is a perspective view of key elements of the safety apparatus for the spring powered stapler of FIG. 1. The driving blade 60 has an opening 62 for accommodating the power spring 50. When the power spring 50 is made of a plate spring, the opening 62 on the driving blade 60 is a horizontally elongated slot. Another opening 67 on the driving blade 60 is for engaging the hook 82 on the hook plate 80. A width of the top portion 65 of the driving blade 60 is narrower than that of the low portion of the driving blade 60. The lower portion is for the driving blade 60 to be able to slide up and down in a vertical channel (not shown) formed on the inner sidewalls of the housing body. The narrower top portion 65 is where the opening 67 locates. Both an opening 87 on the hook plate 80 and an opening 97 on the link plate 90 are wider than the top portion 65, so that the driving blade 60 can engage the hook 82 without interfering the sliding of the hook plate 80 and link plate 90.

Both the hook plate 80 and the link plate 90 have respective openings 85 and 92 to accommodate the top end of the safety pin 70. The push piece 93 on the link plate 90 may be formed by punching down a piece of the link plate 90 to form a protruding object on the bottom of the link plate 90 when the link plate 90 is made of a metal material. The opening 95 on the link plate 90 allow the push-down rod 22 to go through. The edge 96 on a rear side of the opening 95 comes into contact with the wedge-shaped-surface 24 when the handle 20 is pressed down. When further pressing down the handle 20, the wedge-shaped-surface 24 will force the link plate 90 to slide backward.

Referring again to FIG. 3, a cut-off area 99 on each side of the link plate 90 is for accommodating the push-forward spring 97 (not shown in FIG. 3). When the handle 20 is released, the return spring 55 pushes up the handle 20, so that the wedge-shaped surface will disengage the link plate 90. Then the push-forward spring 97 urges the link plate 90 to slide forward. At the same time, the push piece 93 on the link plate 90 pushes the hook plate 80 to the frontal position to re-engage the driving blade 60.

The above illustrations provide many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A safety apparatus for a stapler, the safety apparatus comprising:

a first plate having a hook and a first opening, wherein when the first plate is in a first position, the hook engages a driving blade for preventing the same from driving out a staple;

a second plate substantially parallel to the first plate and having a second opening;

a pin having a first and second end; and a first spring urging the pin downward with the first end of the pin protruding from a bottom of a housing body of the stapler and the second end of the pin below the second plate, wherein when the housing body is pressed against an object, the first end of the pin is pushed into the housing body, and the second end of the pin is inserted into both the first and second openings.

2. The safety apparatus of claim 1 further comprising at least one second spring urging the second plate to move forward; and wherein the second plate comprises a protruding member pushing the first plate into the first position at the urge of the at least one second spring.

3. The safety apparatus of claim 1 further comprising a power spring engaging the driving blade through one or more openings thereon.

4. The safety apparatus of claim 1, wherein the driving blade has a third opening, wherein when the first plate is in the first position, the hook is inserted in the third opening.

5. The safety apparatus of claim 1, wherein the pin is made of a flexible material.

6. The safety apparatus of claim 1, wherein the second plate comprises an edge for pulling the second plate rearward, wherein with the pin inserted in both the first and second openings, when the second plate is pulled rearward, the first plate follows the second plate to a second position where the hook disengages the driving blade.

7. The safety apparatus of claim 1, wherein the first and second plate are slidably contained in a first and second channel, respectively, the first and second channel being formed by the housing body of the stapler.

8. A safety apparatus for a stapler, the safety apparatus comprising:

a first plate having a hook and a first opening, wherein when the first plate is in a first position, the hook engages a driving blade for preventing the same from driving out a staple;

a second plate substantially parallel to the first plate and having a second opening;

at least one first spring urging the second plate to move forward;

a pin having a first and second end; and a second spring urging the pin downward with the first end of the pin protruding from a bottom of a housing body of the stapler and the second end of the pin below the second plate, wherein when the housing body is pressed against an object, the first end of the pin is pushed into the housing body, and the second end of the pin is inserted into both the first and second openings.

9. The safety apparatus of claim 8, wherein the second plate comprises a protruding member pushing the first plate into the first position at the urge of the at least one first spring.

10. The safety apparatus of claim 8 further comprising a power spring engaging the driving blade through one or more openings thereon.

11. The safety apparatus of claim 8, wherein the driving blade has a third opening, wherein when the first plate is in the first position, the hook is inserted in the third opening.

12. The safety apparatus of claim 8, wherein the pin is made of a flexible material.

13. The safety apparatus of claim 8, wherein the second plate comprises an edge for pulling the second plate rearward, wherein with the pin inserted in both the first and second openings, when the second plate is pulled rearward, the first plate follows the second plate to a second position where the hook disengages the driving blade.

14. The safety apparatus of claim 8, wherein the first and second plate are slidably contained in a first and second channel, respectively, the first and second channel being formed by the housing body of the stapler.

15. A safety apparatus for a stapler, the safety apparatus comprising:

a first plate having a hook and a first opening, wherein when the first plate is in a first position, the hook is inserted into a second opening on a driving blade for locking the driving blade;

a second plate substantially parallel to the first plate and having a third opening;

a pin having a first and second end; and a first spring urging the pin downward with the first end of the pin protruding from a bottom of a housing body of the stapler and the second end of the pin below the second plate, wherein when the housing body is pressed against an object, the first end of the pin is pushed into the housing body, and the second end of the pin is inserted into both the first and third openings.

16. The safety apparatus of claim 15 further comprising at least one second spring urging the second plate to move forward; and wherein the second plate comprises a protruding member pushing the first plate into the first position at the urge of the at least one second spring.

17. The safety apparatus of claim 15 further comprising a power spring engaging the driving blade through one or more openings thereon.

18. The safety apparatus of claim 15, wherein the pin is made of a flexible material.

19. The safety apparatus of claim 15, wherein the second plate comprises an edge for pulling the second plate rearward, wherein with the pin inserted in both the first and third openings, when the second plate is pulled rearward, the first plate follows the second plate to a second position where the hook is withdrawn from the second opening of the driving blade.

20. The safety apparatus of claim 15, wherein the first and second plate are slidably contained in a first and second channel, respectively, the first and second channel being formed by the housing body of the stapler.

* * * * *